US005789341A

United States Patent [19]

Furukawa

[11] Patent Number: 5,789,341

[45] Date of Patent: Aug. 4, 1998

[54] METHOD FOR FABRICATING AN IMAGED FILM

[76] Inventor: Kenichi Furukawa, 1-11-13, Yukarigaoka, Sakura-shi, Chiba, 285, Japan

[21] Appl. No.: 831,363

[22] Filed: Apr. 1, 1997

[30] Foreign Application Priority Data

Apr. 11, 1996 [JP] Japan ..... 8-123865

[51] Int. Cl.[6] ..... B41M 5/035; B41M 5/38

[52] U.S. Cl. ..... 503/227; 156/235; 427/152; 428/195; 428/209; 428/210; 428/421; 428/422; 428/500; 428/522; 428/913; 428/914

[58] Field of Search ..... 8/471; 156/235; 427/152; 428/195, 209, 210, 421, 422, 500, 522, 913, 914; 503/227

[56] References Cited

FOREIGN PATENT DOCUMENTS

03018866-A 1/1991 Japan ..... 428/195

08305304-A 11/1996 Japan ..... 503/227

*Primary Examiner*—Bruce H. Hess

*Attorney, Agent, or Firm*—Joseph C. Mason, Jr.

[57] ABSTRACT

The present invention provides a method for fabricating an imaged film, comprising the steps of: providing a laminate film for thermal transfer comprising an opaque film layer having no affinity for a sublimating dye and a transparent film layer laminated on the opaque film layer; contacting a transfer paper having an image formed with a recording material containing the sublimating dye on a surface of the opaque film layer; and heating the transfer paper to diffuse the sublimated dye through the opaque film layer into the transparent film layer. The method enables one to fabricate an imaged film with which when viewed from the side of the transparent film surface opposite to the thermal transfer surface, a high density image backed by the opaque film appears on the film surface having excellent glossiness.

8 Claims, No Drawings

METHOD FOR FABRICATING AN IMAGED FILM

BACKGROUND OF THE INVENTION

The present invention relates to a method for fabricating imaged films for use in advertisement, signs, displays and the like and more particularly to a method for fabricating imaged films which can provide high density, glossy images with ease.

DESCRIPTION OF RELATED ART

In the fabrication of imaged films for use in the fields of advertisement, illumination signs, displays and so on, there has been known a method in which an electrostatic plotter is used. In this method, images are recorded on a static recording paper which comprises base paper having a resin coating layer thereon, the imaged surface of the recording paper is laminated with a transparent film, and the laminate is immersed in water to remove the base paper and obtain an intermediate material consisting of the transparent film on which the image recording layer is attached, the intermediate material is dried, and the surface of the image recording layer is laminated again with a white film.

This process can give rise to imaged films with the image being sandwiched between a transparent film and a white film.

Images outputted by the electrostatic plotter are more water resistant than those obtained by ink jet printers, are resistant to ultraviolet rays to some extent, and can be outputted in high speeds and in large widths. Furthermore, the method using an electrostatic plotter permits outputting images on a large-scale printer connected to a computer so that imaged films for large-scale advertisement, signs electrostatic images which are demanded in rather smaller numbers can be fabricated with ease. Despite the advantages, the method suffers from problems that the process is complicated and inefficient, the material for laminate films is expensive, and so on.

On the other hand, there is known a sublimation heat transfer dying method in which images are printed on a transfer paper with a recording material containing a sublimating dye and the imaged surface is contacted on a polyester cloth followed by heating to dye the polyester cloth. This method is based on the principle that the dye sublimated by heat diffuses to amorphous portions of polyester fibers swollen by heat and confined therein.

With view to producing textile prints in small numbers by plate making-less dying method utilizing this principle, the present inventor proposed an electrostatic image dying method comprising the steps of forming an electrostatic charge image by applying an electric field to an electrostatic recording medium using an electrostatic plotter, developing the electrostatic image with a liquid developer containing a sublimating dye, and contacting the developed image with a polyester cloth with heating to dye the polyester cloth (JP-A-3-18866). This method is advantageous in that there can be prepared a transfer paper for use in a sublimating thermal transfer dying method designed for preparing large images.

The present inventor made intensive investigation based on a working hypothesis that there can also be used, besides polyester fibers, a wide variety of resin films, including crosslinked and cured resins, that do not melt completely at temperatures ranging from 130° to 140° C., although they may undergo gelling to some extent, that cause no substantial shrinkage at such temperatures as above, and from that the dye will not bleed.

First, as the resin film, sublimating thermal transfer dying has been tested on white polyvinyl chloride films prepared by casting with view to finding applicability to polyvinyl chloride films which are practically useful in view of processability, elongation, weatherability, and so on. As a result, no high density image can be developed. Furthermore, the film surface which became softened upon thermal transfer and bonded strongly to the surface of electrostatic medium which is uneven and matte, so that the film surface lost lust. To add, there was observed deterioration of image quality which would be attributable to bleeding, upon rapid heating, of the plasticizer contained in the polyvinyl chloride film in large amounts to the surface of the film bonded to the transfer paper surface.

Previously, the present inventor proposed a method for fabricating a backlit illumination display film (JP-A-8-305304). This technique is intended to fabricate display films which can be fabricated by using a fabrication method coupled with an image adaptation system utilizing a computer, which do not deteriorate readily with ultraviolet rays in the sunlight or backlit illumination source, and which develop color in high density with backlit illumination. More particularly, the method is a method for fabricating a display film which comprises the steps of contacting a transfer paper having formed thereon an image with a recording material containing a sublimating dye on a translucent film comprised of a resin having no affinity for the sublimating dye and a white pigment dispersed in the resin and heating the transfer paper to sublimate the dye so that the dye can diffuse in the inside of the film.

In the above publication, the present inventor disclose among others existence of some specific resins that have low affinity for sublimating dyes, such resins including olefin resins, vinyl alcohol resins, and fluorine-containing resins, and the tendency of the sublimated dyes migrating through the films of such resins due to their specific properties depending on the thermal transfer conditions.

Taking into consideration also the knowledge in combination, the reason for failure of high density color development when sublimating thermal transfer dying is performed on white polyvinyl chloride films would be attributable to the fact that the polyvinyl chloride lacks affinity for the sublimating dye so that the sublimated dye is not trapped by the film surface and diffuses in the inside of the white film, resulting in that the image formed in the film is shielded by the white pigment which diffused in the film.

Therefore, an object of the present invention is to provide a method for fabricating an imaged film which develops colors with high densities by sublimating thermal transfer dying and has luster on the image surface.

SUMMARY OF THE INVENTION

As a result of intensive investigation, the inventor has found that when a two-layered laminate film comprising a first opaque film comprised by a resin having no affinity for a sublimating dye and a second film comprised by a transparent resin is provided and the first opaque film layer is subjected to sublimating thermal transfer, the dye passes through the first opaque film layer which contacts a thermal transfer surface, diffuses into the second transparent film layer, and further that when viewed from the side of the transparent film opposite to the thermal transfer surface, a high density image backed by the opaque film can be observed on the transparent film surface having excellent glossiness.

DISCLOSURE OF THE INVENTION

That is, the present invention relates to a method for fabricating an imaged film comprising the steps of:

providing a laminate film for thermal transfer comprising an opaque film layer having no affinity for the sublimating dye and a transparent film layer laminated on the opaque film layer;

contacting a transfer paper having an image formed with a recording material containing a sublimating dye on a surface of the opaque film layer; and heating the transfer paper to diffuse the sublimated dye through the opaque film layer into the transparent film layer.

Hereinafter, the present invention will be described in detail.

The resin having no affinity for sublimating dyes include olefin resins, e.g., polyethylenes, polypropylenes, etc.; polyvinyl chlorides; vinyl alcohol resins such, e.g., polyvinyl alcohols, polyethylene/vinyl alcohol copolymers, etc.; fluorine-containing resins, e.g., polyvinyl fluorides, polyvinylidene fluorides, polytetrafluoro-ethylenes, tetrafluoroethylene/perfluoroalkylvinylether copolymers, tetrafluoroethylene/hexafluoropropylene copolymers, tetrafluoroethylene/ethylene copolymers, polychlorotrifluoroethylene, etc.; and the like.

In these resins, the dyes can migrate through the resins at different rates depending on the level of affinity for the sublimating dye. When the resins are used as an opaque film in the present invention, generally they may be selected freely with a thickness ranging from 5 to 50 microns as far as the opaqueness is satisfied. In the thermal transfer, however, heat at temperatures ranging from about 130° to about 140° C. is applied for at least about 1 minute and, hence, films fabricated by rolling cannot be used because of shrinking. Generally, films fabricated by casting are preferred since they suffer from thermal shrinkage less frequently.

The opaque film is preferably white and opaque. However, it does not have to be perfectly light-shielding and there can be used those films having adjusted transparency to visible light ranging from 0 to 60% depending on their purposes. In this case, the dye which remains in the opaque film portion serves as a backlit film based on the action of the technique disclosed in JP-A-8-305304 by the present inventor, so that the film of the present invention can be utilized as a day-night film which can be used both during the day and during the night. For this purpose, opacification of films needs to be achieved with white pigments. On the other hand, conventional opacification techniques, i.e., by matting the film surface or by forming foams in the film, may also be used, if it is intended to view the image only from the side of the transparent film with reflected light.

The resin which can be used for a transparent film in the present invention is not limited particularly and any kind of resins may be used as far as they do not cause any problem on heat resistance and shrinkage during the thermal transfer or they cause no bleeding of dyes. The thickness of the resin may be selected freely from the range of 5 to 300 microns. Although preferred are those resins having affinity for the sublimating dyes, such as polyester resins and acrylic resins, because of excellent ability to carry the dyes stably, there can also be used a wide variety of resins including resins having no affinity for the sublimating dyes, such as polyvinyl chlorides, in view of which functions among various properties such as film forming property, heat resistance, processability, stretchability, durability, and so on are to be given priority. When the resins having no affinity for the sublimating dyes are used as the transparent film, in contrast to the case where the resins having affinity for the sublimating dyes are used, the dyes which diffused will remain in the opaque film portion in larger amounts. This is advantageous in that the film will develop colors at considerably high densities with backlight when used as a day-night film.

The sublimating dyes which can be used in the present invention are preferably those which sublimate or evaporate at 70° to 260° C. at atmospheric pressure, for example, azo dyes, anthraquinone dyes, quinophthalone dyes, styryl dyes, di- or triphenylmethane dyes, oxazine dyes, triazine dyes, xanthene dyes, methine dyes, azomethine dyes, cyclizine dyes, diazine dyes, and the like. Besides these, there can be used 1,4-dimethylaminoanthraquinone, 1,5-dihydroxy-4,8-diaminoanthraquinone bromide or chloride, 1,4-diamino-2,3-dichloroanthraquinone, 1-aminohydroxyanthraquinone, 1-amino-4-hydroxy-2-(beta-methoxyethoxy)anthraquinone, methyl, ethyl, propyl or butyl 1,4-diaminoanthraquinone-2-carboxylate, 1-amino-4-anilideanthraquinone, 1-amino-2-cyano-4-anilide (or cyclohexylamino) anthraquinone, 1-hydroxy-2-(p-acetaminophenylazo)-4-methylbenzene, 3-methyl-4-(nitrophenylazo)pyrazolone, 3-hydroxyquinophthalone, and the like.

As the basic dye, there may be used malachite green, methyl violet, dyes modified with sodium acetate, sodium ethylate, sodium methylate or the like.

Minimum requirements for the thermal transfer laminate film which is used in the present invention is that the laminate film must be a two-layered laminate film which comprises a first opaque film layer comprised by a resin having no affinity for a sublimating dye and a second film layer comprised by a transparent resin.

If necessary, an opaque or transparent coating layer or film layer may be provided as an intermediate layer between the first and second layers in order to improve the resistance of images to ultraviolet rays, dye trapping ability, anti-bleeding property, and so on, which is also included by the embodiments of the present invention.

Also, one of the opaque film and transparent film constituting the laminate film may be provided by coating, which is also included by the embodiments of the present invention.

According to the present invention, the dye which diffused through the opaque film layer is trapped on the interface between the opaque film layer and the transparent film layer or peripheral portion thereof at high densities. Accordingly, if the transparent film layer contains an ultraviolet absorbent, ultraviolet ray preventing effect can be obtained, making it unnecessary to laminate a film for shielding ultraviolet rays afterward.

In the present invention, in order for the transparent film surface on the side from which an image is to be observed to keep its glossiness, the surface of a support for thermal transfer which surface contacts the surface of the laminate film opposite to the surface on which a transfer paper contacts upon thermal transfer must be a heat resistant surface excellent in smoothness. In addition, since the sublimating dye may migrate through the transparent film layer to contaminate the surface of the support, generally the surface of the support is preferred to comprise a metallic or glassy material that does not permit penetration of dyes, if it is attempted to repeatedly employ the support apparatus for thermal transfer. When thermal transfer laminate films are fabricated by casting, where a molten resin is cast on a sheet called process paper made of a smooth base paper coated with a release agent such as silicone resin, thermal transfer conducted with the process paper being attached as is, i.e., use of the process paper itself as the surface of the support upon thermal transfer, gives rise to images having no deterioration in the image surface after the thermal transfer and retaining an excellent glossiness. This would be because the cast resin and the surface of process paper, though they are not bonded, form an integrated structure without intervening air therebetween, thus ensuring that the glossiness of the surface of film can be retained and contributing to preventing the plasticizer from bleeding up to the surface of film contacting the process paper upon an abrupt increase in temperature. The process paper is disposed of later on so that there is no need of considering contamination of the surface of support, which is convenient.

To laminate an opaque film and a transparent film, the casting method described above is preferred although the films can also be bonded with an adhesive if the films have no adhesiveness therebetween.

As described above, the present invention provides a method for fabricating an imaged film comprising the steps of: providing a laminate film for thermal transfer comprising an opaque film layer having no affinity for the sublimating dye and a transparent film layer laminated on the opaque film layer; contacting a transfer paper having an image formed with a recording material containing a sublimating dye on a surface of the opaque film layer; and heating the transfer paper to diffuse the sublimated dye through the opaque film layer into the transparent film layer.

According to the method of the present invention, there can be fabricated at low costs by a simple process using a large-scale printer connected to a computer imaged films which have excellent glossiness, can be used as a backlit film too, and are excellent in resistance to ultraviolet rays. The resultant imaged films, when viewed from the side of the transparent film opposite to the thermal transfer surface, displays a high density image on a glossy film surface backed by the opaque film.

BEST MODE FOR CARRYING OUT THE INVENTION

Hereafter, the invention will be described in more detail by examples. However, the present invention is not limited by the following examples.

EXAMPLE 1

On a process paper was laminated a first layer of a transparent polyvinyl chloride resin to a thickness of 60 microns. Further, on this layer was laminated a second layer of a white polyvinyl chloride resin having dispersed therein a pigment and having a transmittance of visible light of 5% to a thickness of 40 microns. The polyvinyl chloride resin used here is a so-called semi-hard type one having a polymeric plasticizer blended therein, which has good weatherability. On the surface of the laminate film with the process paper attached was superposed a transfer paper for gravure printing manufactured by TOPPAN PRINTING CO., LTD. containing a sublimating dye as a coloring material for ink, and the laminate was heated at 130° C. for 5 minutes on an infrared lamp-heated vacuum thermal transfer machine "HTM-512" (trade name for a product by SIGNTEC, INC.). Thereafter, the thermally transferred integrated material was removed of the process paper and the transfer paper to obtain an imaged film. When the imaged film was viewed from the side of the transparent film surface, a high density transferred image was observed on the transparent film surface retaining glossiness.

EXAMPLE 2

On a process paper was laminated a first layer of a transparent polyvinyl chloride resin to a thickness of 60 microns. Further, on this layer was laminated as a second layer a translucent white polyvinyl chloride resin comprised by the above polyvinyl chloride having dispersed therein a pigment and having a transmittance of visible light of 25% to a thickness of 40 microns. On the surface of the laminate film with the process paper attached was superposed an electrostatic recording paper having an image outputted by an electrostatic plotter "JUANA" (trade name for a product by NIPPON STEEL CO., LTD.) based on the "electrostatic image dyeing method" disclosed in JP-A-3-18866, and the laminate was heated at 130° C. for 5 minutes on the infrared lamp-heated vacuum thermal transfer machine HTM-512. Thereafter, the thermally transferred integrated material was removed of the process paper so that a high density transferred imaged retaining glossiness was observed on the transparent film surface. Then, the integrated product immersed in water to dissolve a gluing coating layer made of ammonium salt underlying the resin coating layer, the outermost layer of the electrostatic recording paper, thus releasing the base paper of the electrostatic recording paper from the integrated product to give rise to an imaged film. The imaged film, when it was set on a backlit illumination apparatus and illuminated, gave an image density as high as Colton film, a conventional backlit illumination film by silver halide photography.

EXAMPLE 3

On a 50 micron thick white film comprised by the above-described polyvinyl chloride resin (transmittance of visible light: 5%) was coated a transparent, ultraviolet shielding coating agent "W9663" (trade name for a product by SHOWA TECHNOCOAT CO., LTD.) comprised by an acrylic resin of a crosslink-curing type followed by curing to laminate a 10 micron thick transparent resin layer. Then, the resulting laminate film was placed on a glass plate having a smooth surface, with the white film surface up. Further, on the white film surface was superimposed an electrostatic recording paper having thereon an image outputted by the above-described electrostatic plotter JUANA. The resulting integrated product was set on the above-described vacuum thermal transfer machine HTM-512 and heated at 130° C. for 5 minutes. Thereafter, the same operation as in Example 2 was performed to obtain an imaged film. When the imaged film thus obtained was viewed from the side of the transparent coating layer, a high density transferred image retaining glossiness was observed on the surface of the transparent coating layer.

EXAMPLE 4

On a 50 micron thick transparent film comprised by the above-described polyvinyl chloride resin (transmittance of visible light: 5%) and a 25 micron thick translucent white film made of polyvinyl fluoride resin "TEDLER TVW10AH8" (a trademark for a product by DuPONT, transmittance of visible light: 30%) were plied with a silicone adhesive "SD4570/PSA" (a trademark for a product by TOHRAY DOW CORNING SILICONE CO., LTD.) to form a laminate film. Then, the resulting laminate film was placed on a glass plate having a smooth surface, with the translucent white TEDLER film surface up. Further, on the translucent white TEDLER film surface was superimposed an electrostatic recording paper having thereon an image outputted by the above-described electrostatic plotter JUANA. The resulting integrated product was set on the above-described vacuum thermal transfer machine HTM-512 and heated at 130° C. for 5 minutes. Thereafter, electrostatic recording paper was peeled off to obtain an imaged film. When the imaged film thus obtained was viewed from the side of the transparent film surface, a high density transferred image retaining glossiness was observed on the surface of the transparent coating layer. The imaged film, when it was set on a backlit illumination apparatus and illuminated, gave an image density as high as Colton film, a conventional backlit illumination film by silver halide photography.

What is claimed is:

1. A method for fabricating an imaged film, comprising the steps of:

providing a laminate film for thermal transfer comprising an opaque film layer having no affinity for a sublimating dye and a transparent film layer laminated on the opaque film layer;

contacting a transfer paper having an image formed with a recording material containing the sublimating dye on a surface of said opaque film layer; and heating said transfer paper to diffuse the sublimated dye through said opaque film layer into said transparent film layer.

2. The method for fabricating an imaged film as claimed in claim 1, wherein said laminate film for thermal transfer is made by casting a transparent film layer and an opaque film layer on a material comprised by a base paper having a smooth surface coated with a releasing agent.

3. The method for fabricating an imaged film as claimed in claim 1, wherein said laminate film for thermal transfer is made by superimposing a transparent film layer and an opaque film layer on a smooth material impermeable to the dye.

4. The method for fabricating an imaged film as claimed in claim 3, wherein the smooth material impermeable to the dye is a metallic material or a glass material.

5. The method for fabricating an imaged film as claimed in claim 1, wherein said laminate film for thermal transfer is made by plying a transparent film and an opaque film with an adhesive.

6. The method for fabricating an imaged film as claimed in claim 1, wherein said opaque film is made by dispersing a pigment in a resin material selected from the group consisting of olefin resins, polyvinyl chloride, vinyl alcohol resins and fluorine containing resins.

7. The method for fabricating an imaged film as claimed in claim 6, wherein the pigment is a white pigment.

8. The method for fabricating an imaged film as claimed in claim 6, wherein said opaque film has a transmittance of visible light ranging form 0 to 60%.

* * * * *